US010920400B2

(12) United States Patent
Cashman et al.

(10) Patent No.: US 10,920,400 B2
(45) Date of Patent: Feb. 16, 2021

(54) DRAGGING APPARATUS WITH RIPPER SHANK

(71) Applicant: CASHMAN DREDGING AND MARINE CONTRACTING, CO., LLC, Quincy, MA (US)

(72) Inventors: Jay Cashman, Quincy, MA (US); Frank Belesimo, Easton, MA (US); Aiden Horan, Hampton Falls, NH (US); Timothy Mannering, Marshfield, MA (US); Norman Bourque, Rochester, MA (US)

(73) Assignee: CASHMAN DREDGING AND MARINE CONTRACTING, CO., LLC, Quincy, MA (US)

( * ) Notice: Subject to any disclaimer, the term of this patent is extended or adjusted under 35 U.S.C. 154(b) by 0 days.

(21) Appl. No.: 16/724,636

(22) Filed: Dec. 23, 2019

(65) Prior Publication Data

US 2020/0208375 A1 Jul. 2, 2020

Related U.S. Application Data

(60) Provisional application No. 62/784,973, filed on Dec. 26, 2018.

(51) Int. Cl.

| | |
|---|---|
| ***E02F 9/20*** | (2006.01) |
| ***E02F 5/00*** | (2006.01) |
| ***E02F 9/28*** | (2006.01) |
| ***E02F 3/815*** | (2006.01) |
| ***E02F 3/90*** | (2006.01) |
| *E02F 5/28* | (2006.01) |

(52) U.S. Cl.

CPC ..... *E02F 9/2041* (2013.01); *E02F 3/815* (2013.01); *E02F 3/907* (2013.01); *E02F 5/006* (2013.01); *E02F 9/2875* (2013.01); *E02F 5/285* (2013.01)

(58) Field of Classification Search

CPC ..... E02F 9/2041; E02F 9/2875; E02F 9/06; E02F 9/065; E02F 3/815; E02F 3/106; E02F 5/006; E02F 5/285; E02F 3/907; A01B 3/64; A01B 13/08; A01B 15/06

See application file for complete search history.

(56) References Cited

U.S. PATENT DOCUMENTS

| | | | | |
|---|---|---|---|---|
| 1,063 A * | 1/1839 | Brayton et al. | ..... | E02F 5/287 37/342 |
| 2,083 A * | 5/1841 | Putnam | ..... | E02F 5/287 37/342 |
| 3,818 A * | 11/1844 | Vermillion | ..... | E02F 5/287 37/342 |
| 43,664 A * | 8/1864 | Benjamin | ..... | E02F 5/287 37/342 |

(Continued)

*Primary Examiner* — Jamie L McGowan

(74) *Attorney, Agent, or Firm* — Jacob M. Ward; Ward Law Office LLC

(57) ABSTRACT

A dragging apparatus has a carriage body. The carriage body has at least one attachment portion. The attachment portion is configured to connect the carriage body to a drag barge. At least one ripper shank is disposed on the carriage body. The ripper shank extends downwardly from the carriage body. A method for operating a dragging apparatus includes providing a barge and a dragging apparatus, and then lowering the dragging apparatus to a floor or bottom of a body of water to agitate the floor or bottom.

17 Claims, 5 Drawing Sheets

(56) References Cited

U.S. PATENT DOCUMENTS 204,387 A * 5/1878 Smith ..... E02F 5/287 37/342
262,828 A * 8/1882 Peterson ..... E02F 5/287 37/342
281,905 A * 7/1883 Meinesz ..... E02F 5/287 37/342
306,206 A * 10/1884 Alrick ..... E02F 5/287 37/342
307,289 A * 10/1884 Gates ..... E02F 5/287 37/342
308,211 A * 11/1884 Stanke ..... E02F 5/287 37/342
315,520 A * 4/1885 Lonney ..... E04G 23/006 299/36.1
416,999 A * 12/1889 Coult ..... E02F 5/287 37/342
449,184 A * 3/1891 Solomon ..... E02F 5/287 37/342
486,957 A * 11/1892 Schaffer ..... E02F 5/287 37/342
526,675 A * 10/1894 Bernard ..... E02F 3/60 172/26.6
546,181 A 9/1895 Nielsen
753,217 A * 3/1904 Allman ..... E02F 5/287 37/342
1,062,924 A * 5/1913 Mercer ..... E02F 5/287 37/342
1,192,127 A * 7/1916 Shostrom ..... E02F 3/60 172/26.6
1,332,609 A * 3/1920 Crawford ..... E02F 3/52 37/401
1,428,880 A * 9/1922 De Mott ..... A01B 31/00 172/684.5
1,531,743 A * 3/1925 Falley ..... E02B 3/02 405/73
1,583,132 A * 5/1926 Falley ..... E02B 3/02 405/73
2,070,964 A * 2/1937 Scott ..... B60R 19/54 172/833
2,100,956 A * 11/1937 Hemmert ..... A01B 19/02 172/322
2,261,233 A * 11/1941 Dausman ..... E02F 3/60 37/398
2,795,111 A * 6/1957 Richardson ..... E02F 5/104 405/161
3,556,598 A * 1/1971 Smith ..... E02F 3/92 299/8
3,624,932 A * 12/1971 Doyle ..... A01K 80/00 37/308
3,698,485 A * 10/1972 Trimpe ..... A01B 33/021 172/65
4,312,144 A * 1/1982 Ezoe ..... E02F 5/106 37/367
4,410,297 A * 10/1983 Lynch ..... E02F 5/104 242/397.3
4,538,937 A * 9/1985 Lynch ..... E02F 5/104 242/156
4,661,019 A * 4/1987 McLaughlin ..... E02F 5/106 405/174
4,844,658 A * 7/1989 Kohn ..... E02F 5/104 405/159
4,902,038 A * 2/1990 Grover ..... B60R 13/01 105/422
5,140,761 A * 8/1992 Coffman ..... E02F 3/58 24/129 A
6,050,009 A * 4/2000 Adamson ..... E02F 5/102 37/367
6,116,818 A * 9/2000 Bitetto ..... E02F 5/102 37/322
6,216,796 B1 * 4/2001 Frank ..... A01B 31/00 172/684.5
7,048,069 B1 * 5/2006 Bollich ..... A01B 21/086 172/139
7,181,871 B2 * 2/2007 Sower ..... A01C 3/04 37/317
2010/0139130 A1 * 6/2010 Wagenaar ..... B63C 11/52 37/342
2011/0239493 A1 * 10/2011 Tack ..... E02F 3/9212 37/333
2011/0296720 A1 * 12/2011 Tack ..... E02F 3/9256 37/323
2012/0234565 A1 * 9/2012 Kiser ..... A01B 35/08 172/145

* cited by examiner

DRAGGING APPARATUS WITH RIPPER SHANK

CROSS-REFERENCE TO RELATED APPLICATIONS

This application claims the benefit of U.S. Provisional Application No. 62/784,973 filed on Dec. 26, 2018. The entire disclosure of the above application is hereby incorporated herein by reference.

FIELD

The present disclosure relates to marine construction and, more particularly, to a dredging device that is dragged under a barge to gouge a floor or bottom of a body of water.

BACKGROUND

Dredging is defined as the underwater removal of soil, such as sand, gravel, and rocks, and its transport from one place to another.

In certain areas, the sea floor is hardened or rocky, or there are compact areas, or the sea floor is made of stiff, hard soils. In these areas, traditional dredging is not economical. Typically, these compacted areas of sea floor may be excavated with equipment on board the barge. However, an excavator may not be available for every project.

There is a continuing need for a dragging apparatus for loosening compacted materials from a floor or bottom of a body of water for dredging.

SUMMARY

In concordance with the instant disclosure, a dragging apparatus for loosening compacted materials from a floor or bottom of a body of water for dredging has been surprisingly discovered.

In one embodiment, a dragging apparatus has a carriage body. The carriage body has at least one attachment portion. The attachment portion is configured to connect the carriage body to a drag barge. At least one ripper shank is disposed on the carriage body. The ripper shank extends downwardly from the carriage body.

In another embodiment, a dragging apparatus and barge assembly has a carriage body. The carriage body has at least one attachment portion. The attachment portion connects the carriage body to the barge. At least one ripper shank is disposed on the carriage body. The ripper shank extends downwardly from the carriage body.

In a further embodiment, a method for operating a dragging apparatus includes steps of providing a barge and a dragging apparatus. The dragging apparatus has a carriage body. The carriage body has at least one attachment portion. The attachment portion is configured to connect the carriage body to a drag barge. At least one ripper shank is disposed on the carriage body. The ripper shank extends downwardly from the carriage body. Next, the method includes a step of lowering the dragging apparatus to a floor or bottom of a body of water. Finally, the method includes a step of agitating the floor or bottom with the dragging apparatus.

In an exemplary embodiment, a drag barge with ripper shank system may include at least one drag beam, a pair of hanging lines, a pair of dragging wires, a reel device, and at least one ripper attachment. The ripper shank system may be fabricated as part of the original barge during manufacture, as desired.

The ripper shank system is configured to be dragged along and agitate the bottom or floor of a body of water, such as a sea floor as one example, such that the at least one ripper attachment gouges the bottom or floor. Advantageously, the ripper shank system may be used to loosen compacted or hard areas of the bottom or floor in order to facilitate a subsequent dredging operation.

The at least one drag beam is connected to the drag barge via the pair of hanging wires and the pair of dragging wires. The pair of hanging wires connect the at least one drag beam to a stern of the barge. Each wire of the pair of hanging wires attach to an end of the at least one drag beam. The hanging wires create a substantially 90-degree angle with the barge. The substantially 90-degree angle formed between the barge and the pair of hanging wires may allow the at least one drag beam to stay in place below the stern of the barge in operation. However, other suitable angles between the barge and the pair of hanging wires may also be employed, as desired.

The pair of hanging wires may be attached to the stern of the barge via a reel device disposed on the barge. The reel device of the barge is configured adjust a length of the pair of hanging wires to raise and lower the at least one drag beam. The reel device may be connected to a motor and control system that allows the user to adjust the length of the pair of hanging wires, or may permit for a manual adjustment, for example, by a crank or other means.

The pair of dragging wires connect the at least one drag beam to a bow of the barge. Each wire of the pair of dragging wires connects to an end of the at least one drag beam. Each of the pair of dragging wires may have another end that connects to the stern of the barge. The stern of the barge and the pair of dragging wires create a connection that has a connection angle that is variable depending of the length of the pair of hanging wires, the water depth, and ground type.

The ripper shank system includes at least one ripper attachment configured to gouge or agitate the bottom or floor of the body of water. The at least one ripper attachment may have a main body with a shank, for example.

The main body of the ripper attachment is disposed on the at least one drag beam of the ripper shank system. For example, the ripper attachment may be disposed on top of the at least one drag beam at a location substantially equidistant from the ends of the at least one drag beam. The main body may be configured to receive the shank. It should be understood that one skilled in the art may select any number of ripper attachments arranged in any suitable way, as desired.

The main body in other embodiments may have a first rounded protrusion and a second rounded protrusion disposed on one side of the main body. The first rounded protrusion is disposed adjacent to the bottom of the main body. The first rounded protrusion is configured to connect, either directly or indirectly, the main body and the at least one drag beam. The first rounded protrusion may be designed to allow rotation of the main body about the at least one drag beam during operation.

The second rounded protrusion is disposed above the first rounded protrusion and adjacent the top of the main body of the ripper attachment. The second rounded protrusion may offer support to the connection between the first rounded protrusion and the at least one drag beam, for example, via a connection in compression or a connection in tension.

The main body and the at least one drag beam can be configured multiple ways. Though a variety of configurations are shown and contemplated herein, it should be understood that this disclosure contemplates further configurations of the main body and the at least one drag beam, and such further configurations are considered to be within the scope of the present disclosure.

The shank is disposed in or on the main body. The shank may be hook-shaped, for example, having an end that is curved and which terminates in a shank blade. Though one shank is depicted, it should be understood that a ripper attachment with any suitable number of shanks is contemplated by this disclosure and may be employed.

It should be appreciated that the blade of the shank may be oriented in a direction of motion of the barge. The blade of the shank is configured to create a furrow in an area of bottom or floor as the shank is dragged across the bottom or floor of the body of water by the barge. Advantageously, the blade of the shank is configured to be driven into the area of bottom or floor, for example, due to its curvature and the forward motion of the barge. Thus, the shank is able to loosen hard and compact soil when dragged by the barge in operation.

The ripper attachment may include a front stabilizing device. The front stabilizing device may be disposed on the front of the main body of the ripper attachment. In particular, the front stabilizing device may be a ski-shaped sheet of metal that is affixed to a bottom of the main body on the front end thereof. The front stabilizing device may have a substantially smooth surface that is adapted to allow the main body to drag along the bottom or floor with reduced resistance compared to the main body without the front stabilizer.

The front stabilizing device may have a width that is greater than a width of the main body. Advantageously, the width of the front stabilizing device may provide support to the ripper attachment such that, in operation, the front stabilizing device may militate against the ripper attachment overturning or tipping undesirably while the shank is engaged with the bottom or floor.

In certain embodiments of the present disclosure, the at least one drag beam may be a pair of drag beams. The pair of drag beams includes a first drag beam and a second drag beam. The main body of the ripper attachment may be disposed between the first drag beam and the second drag beam. Advantageously, the pair of drag beams may provide additional support to the ripper attachment. The pair of beams militates against the ripper attachment undesirably tipping in the event that the shank becomes caught on a boulder or other unmovable object.

A more specific embodiment of the present disclosure includes a pair of drag beams. The main body of the ripper attachment is directly disposed on one of the pair of drag beams and spaced apart from the other of the drag beams. The main body is attached to the one of the pair of drag beams via a hinge device. Advantageously, the hinge device allows the ripper attachment to have flexibility and movement in operation. This movement will militate against the ripper attachment from becoming caught on a boulder or other unmovable object.

The ripper shank system may also include an elevation automation system (not shown). The depth of the at least one drag beam may be automatically calculated from GPS data from a dredge site. The reel device may raise or lower the pair of hanging wires to allow the at least one drag beam to interact with the bottom or floor based on the GPS data.

The ripper shank system may also use of bubbler system to assess the vertical elevation of the at least one drag beam below water and the differential elevation from a first end of the at least one drag beam to a second end of the at least one drag beam. This bubbler system may provide real time data on the state of the at least one drag beam below water where it is not visible. The bubbler system also provides real time information on how well the at least one drag beam is capable of leveling the material as it is agitating.

In operation, the ripper shank system may be provided separate from the barge and then installed. Alternatively, the ripper shank system may be provided pre-installed with the barge as a single assembly.

The at least one drag beam is lowered into the water to a depth determined by the automated system so that the shank engages with the bottom or floor. The barge then begins moving and the shank agitates the bottom or floor as the barge moves forward.

During operation, the bubbler system may be monitored to determine the overall stability of the ripper shank system. The automated system will communicate with the reel device to adjust the depth of the at least one drag beam as needed throughout the operation.

DESCRIPTION OF THE DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
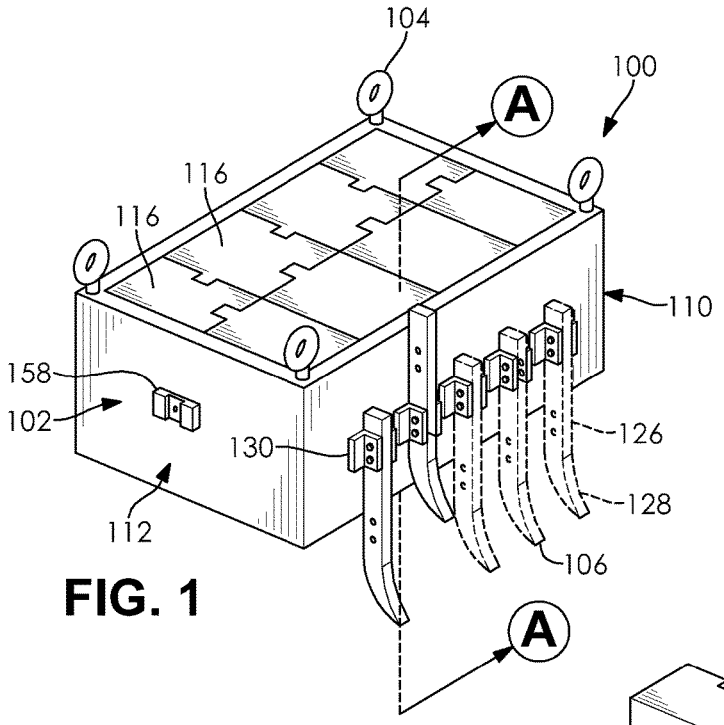
FIG. 1 is a top perspective view of a dragging apparatus, according to one embodiment of the present disclosure.

The following detailed description and appended drawings describe and illustrate various embodiments of the composition. The description and drawings serve to enable one skilled in the art to make and use the composition and are not intended to limit the scope of the composition in any manner. In respect of the methods disclosed, the steps presented are exemplary in nature, and thus, the order of the steps is not necessary or critical unless otherwise disclosed.

The present disclosure relates to a dragging apparatus 100, for example, as shown in FIGS. 1-10. The dragging apparatus 100 may have a carriage body 102. The carriage body 102 may have at least one attachment portion 104, which may be configured to connect the carriage body 102 to a drag barge 101. At least one ripper shank 106 may be disposed on the carriage body 102.

The dragging apparatus 100 may be configured to be dragged along and agitate a bottom or floor of a body of water, such as a sea floor as one example, such that the at least one ripper shank 106 gouges the bottom or floor. Advantageously, the dragging apparatus 100 may be used to loosen compacted or hard areas of the bottom or floor in order to facilitate dredging or marine construction.

With reference to FIGS. 1-4, the carriage body 102 may have a base wall 108, a front wall 110, and a plurality of sidewalls 112. The base wall 108 may be configured to be disposed adjacent to the floor of the body of water, in operation. The attachment portion 104 may be an eyelet as shown in FIG. 1, for example. In certain embodiments, four attachment portions 104 may be disposed on a top surface 111 of the carriage body. More particularly, each of the four attachment portions 104 may be disposed on each corner 113 of the top surface 111 of the carriage body 102. A skilled artisan may select other suitable arrangements for the attachment portions 104, as desired.

Figure 2:
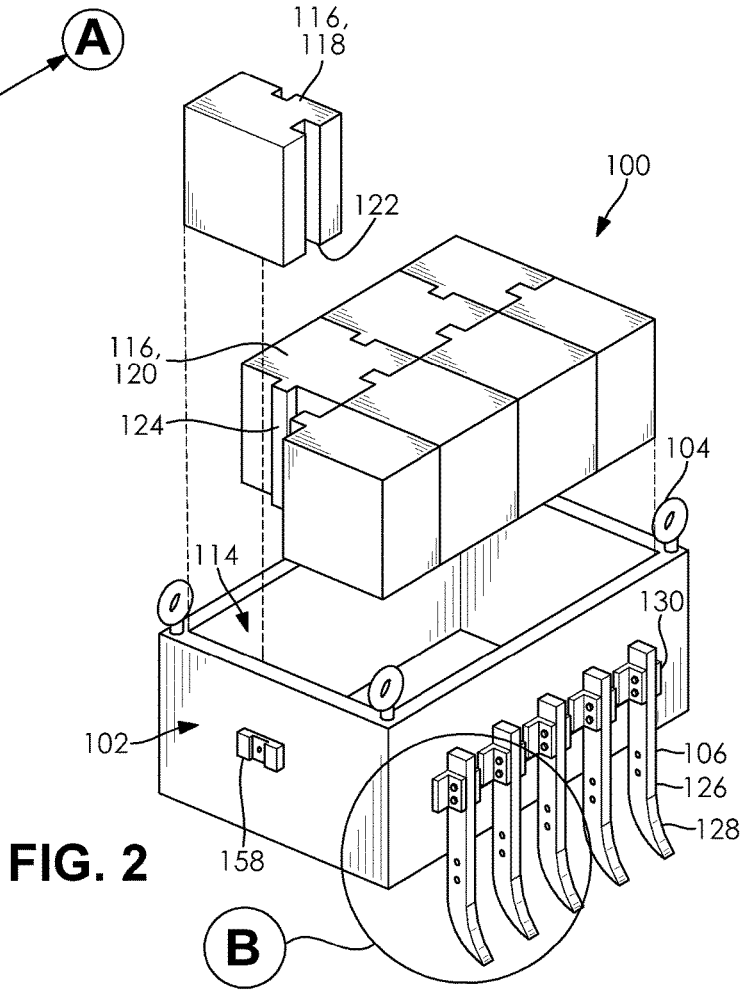
FIG. 2 is an exploded top perspective view of the dragging apparatus in FIG. 1.
Figure 3:
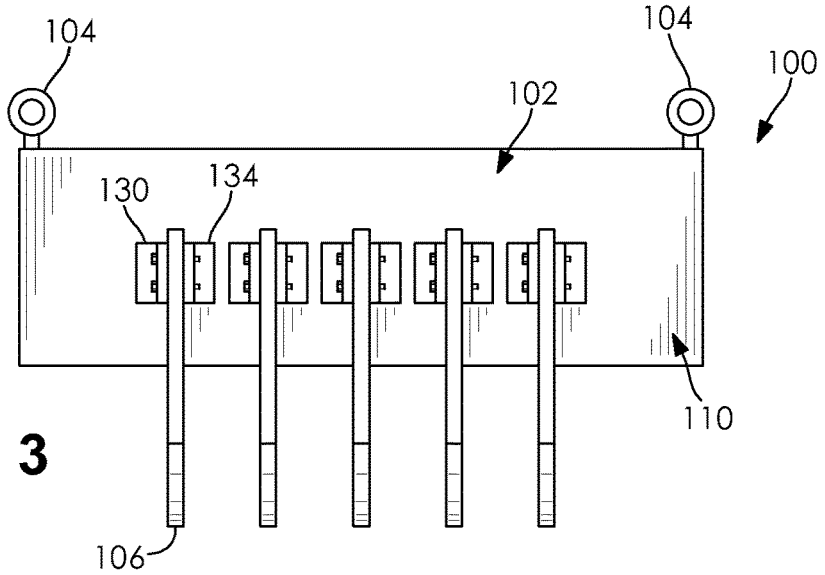
FIG. 3 is a front elevational view of the dragging apparatus of FIG. 1.
Figure 4:
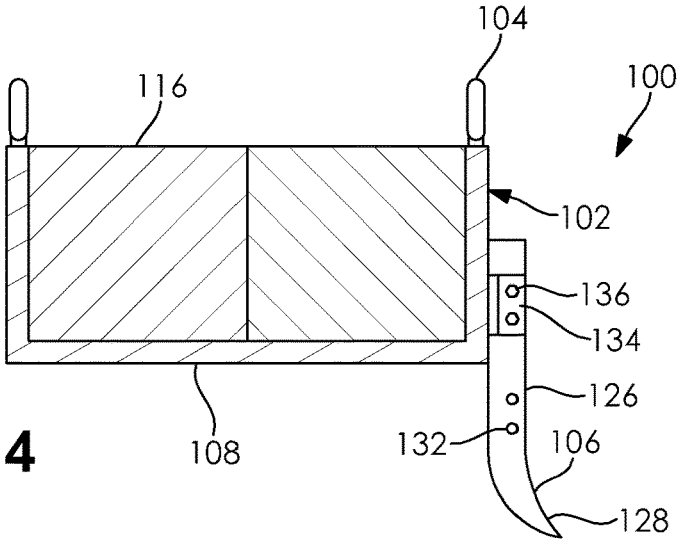
FIG. 4 is a cross sectional side elevational view of the dragging apparatus taken at section line A-A shown in FIG. 1.

The base wall 108, the front wall 110, and the plurality of sidewalls 112 may define a cavity 114, for example, as shown in FIG. 2. The cavity 114 may be configured to selectively receive at least one weight 116. Advantageously, the at least one weight 116 may militate against the carriage body 102 rising from the floor of the body of water, in operation.

In certain embodiments, for example, as shown in FIGS. 1-2, the at least one weight 116 may be a plurality of weights 116. The plurality of weights 118 may be configured to interlock. The plurality of weights 116 may include a first weight 118 and a second weight 120. Each of a first weight 118 and the second weight 120 may have at least of one of a female portion 122 and a male portion 124. The female portion 122 of the first weight 118 may receive the male portion 124 of the second weight 120. Advantageously, the interlocking weights 116 allow each of the plurality of weights 116 to be separable and selectively used in the carriage body 102, as necessary.

It should be appreciated that, in other embodiments, the carriage body 102 may not be configured to receive weights 116. Alternatively, the carriage body 102 may be formed only from interlocking weights 116, or it may be a solid beam, as non-limiting examples.

With reference to FIGS. 1-8, the dragging apparatus 100 may also have at least one ripper shank 106. The ripper shank 106 may be configured to gouge the bottom or floor. The ripper shank 106 have a shaft 126 and a cutting tooth 128, for example.

Figure 9:
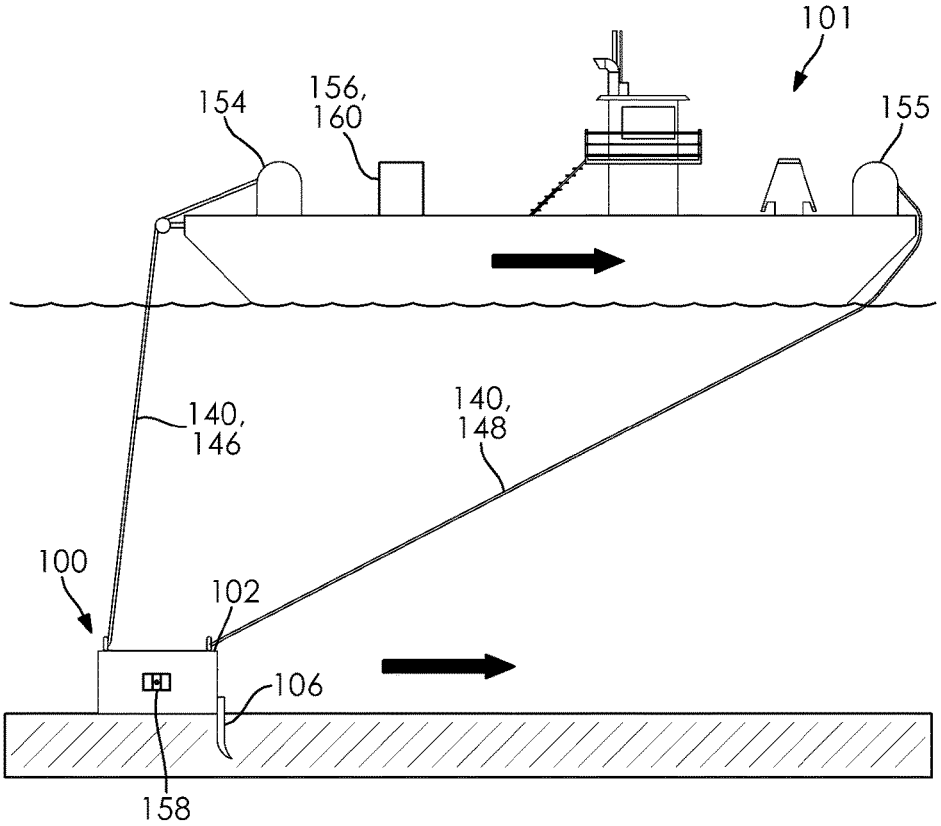
FIG. 9 is a side elevational view of the dragging apparatus and barge assembly of FIG. 8, further depicting the dragging apparatus and barge assembly in operation.
Figure 10:
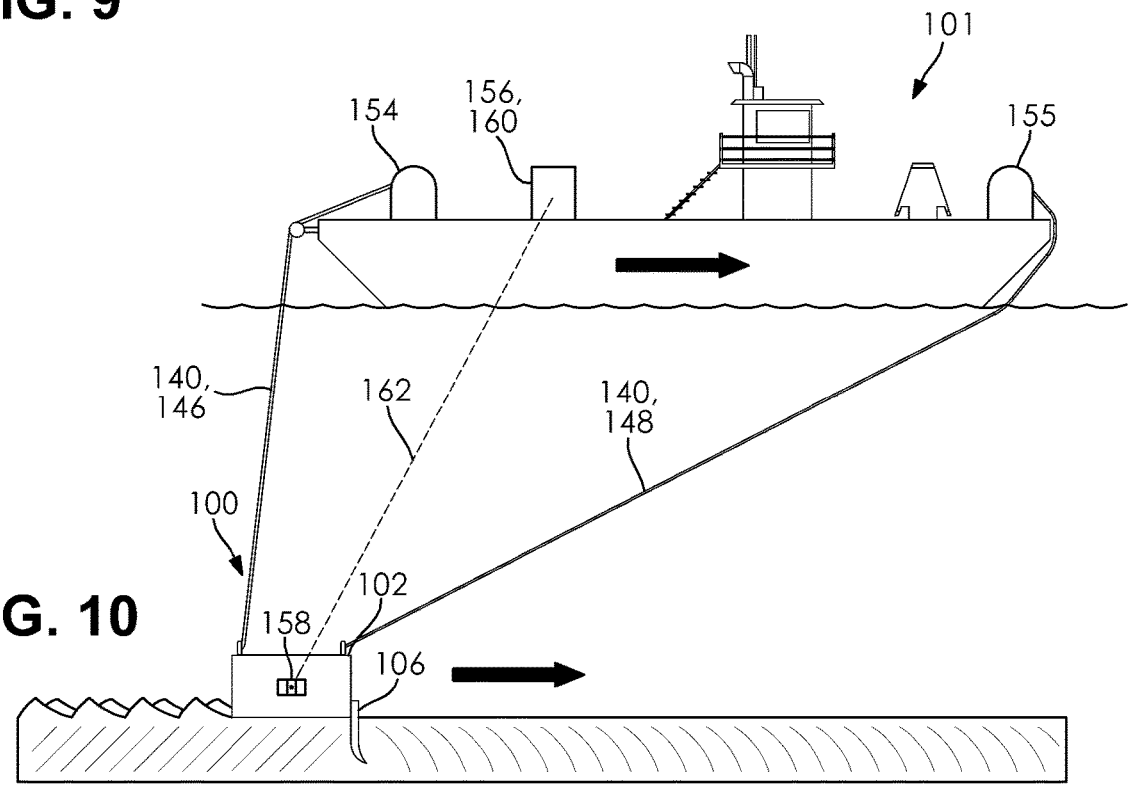
FIG. 10 is a side elevational view of the dragging apparatus and barge assembly of FIG. 9, and further depicting a movement of the dragging apparatus and method of agitating a floor of a body of water.

It should be appreciated that the cutting tooth 128 of the ripper shank 106 may be oriented in a direction of motion of the barge 101, for example as shown in FIGS. 9-10. The cutting tooth 128 of the ripper shank 106 may be configured to create a furrow in an area of bottom or floor, as the ripper shank 106 is dragged across the bottom or floor of the body of water by the barge 101, in operation. Advantageously, the cutting tooth 128 of the ripper shank 106 may be configured to be driven into the area of bottom or floor, for example, due to a curved shape of the cutting tooth 128 and forward motion of the barge. Thus, the ripper shank 106 is able to loosen hard and compact soil when dragged by the barge 101, in operation.

The ripper shank 106 may be disposed on the carriage body 102. More particularly, the ripper shank 106 may be disposed on the front wall 110 of the carriage body 102. In certain embodiments, the at least one ripper shank 106 may be a plurality of ripper shanks 106. The at least one ripper shank 106 may be selectively and removably disposed on the front wall 110 of the carriage body 102. Advantageously, the plurality of ripper shanks 106 may be selectively arranged on the carriage body 102 based on requirements of a particular project. For example, a ripping depth below the carriage can be adjusted vertically such that different depths of cut can be achieved. A skilled artisan may select a suitable number and arrangement of ripper shanks 106 to be utilized, as desired.

As a non-limiting example, the at least one ripper shank 106 may be removably disposed on the front wall 110 of the carriage body 102 with a fastener, for example, a mechanical fastener 130. It should be appreciated that the mechanical fastener 130 may be permanently or removably affixed to the front wall 110 of the carriage body 102 and configured to receive the ripper shank 106. Alternatively, the mechanical fastener 130 may be permanently or removable affixed to the ripper shank 106 and configured to be disposed on front wall 110 of the carriage body 102.

Figure 5:
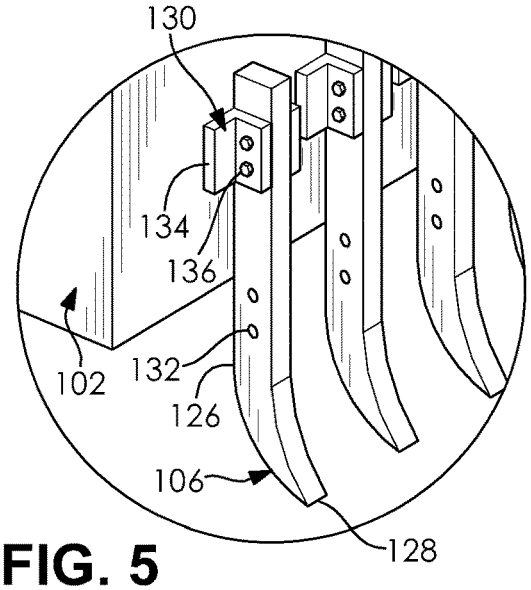
FIG. 5 is an enlarged, fragmentary, top perspective view of a ripper shank of the dragging apparatus taken at callout B in FIG. 2.
Figure 6:
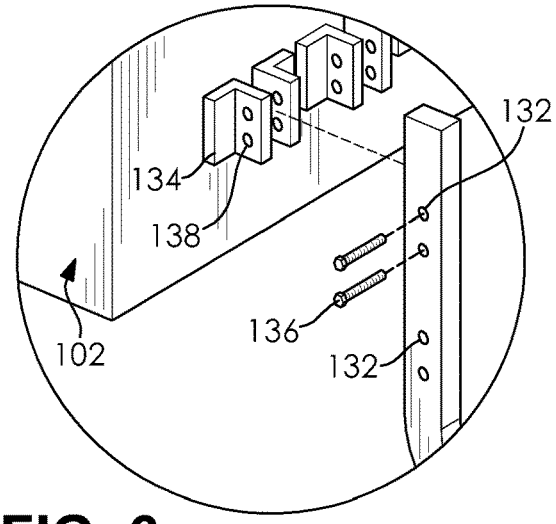
FIG. 6 is an enlarged, exploded, fragmentary, top perspective view of a ripper shank shown in FIG. 5.
Figure 7:
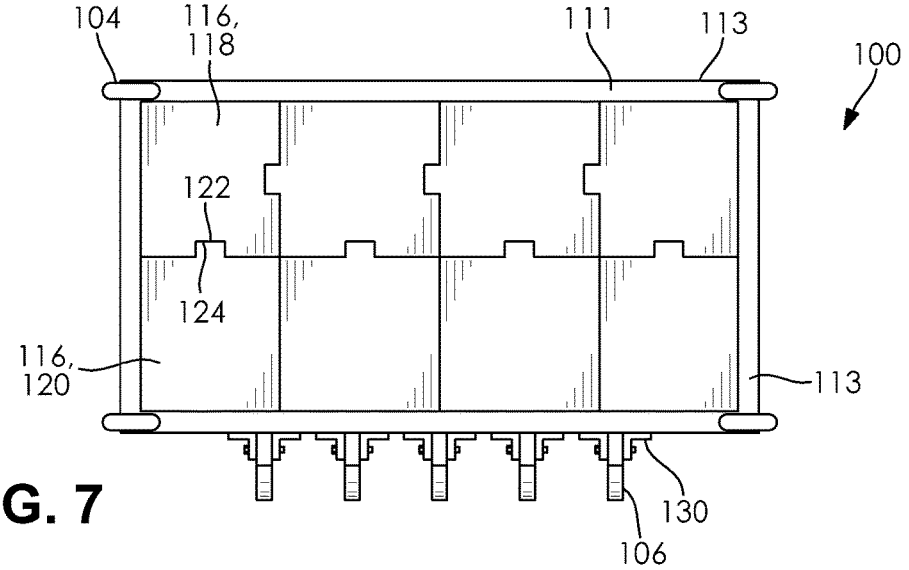
FIG. 7 is a top plan view of the dragging apparatus of FIG. 1.

At least one aperture 132 may be formed through the shaft 126, for example, as shown in FIGS. 5-6. The at least one aperture 132 may be configured to receive the mechanical fastener 130. In more particular embodiments, a plurality of apertures 132 may be formed along a length of the shaft 126. Advantageously, the plurality of apertures 132 allow the shaft 126 to be adjustable. In other words, a cutting depth of the ripper shank 106 may be adjusted based on which aperture 132 receives the mechanical fastener 130. A skilled artisan may select other suitable methods of securing the ripper shank 106 to the carriage body 102, as desired.

In certain embodiments, for example, as shown in FIGS. 5-6, the mechanical fastener 130 may include at least one pair of brackets 134 and at least one bolt 136. Each of the brackets 134 may be disposed on the front wall 110 of the carriage body 102. Each of the brackets 134 may have at least one opening 138 formed therein. The at least one opening 138 of the bracket 134 may correspond to the at least one aperture 132 of the shaft 126 of the ripper shank 106.

Each one of the brackets 134 may be spaced apart a distance from the other bracket 134. The distance is substantially the same as a width of the shaft 126. The shaft 126 may be disposed between the pair of brackets 134 such that the at least one opening 138 of the bracket 134 is aligned with the at least one aperture 132 of the shaft 126 of the ripper shank 106. The at least one bolt 136 may be disposed through the at least one opening 138 of each of the brackets 134 and the at least one aperture 132 of the shaft thereby securing the shaft 126 of the ripper shank 106 to the carriage body 102.

The dragging apparatus 100 may further include at least one line 140. The line 140 may be fabricated from a durable material. The durable material may be submerged in fresh or salt water for extended periods of time without damaging the line 140. The line 140 may be one of a wire, a rope, and a chain, as non-limiting examples. A skilled artisan may select other suitable materials and configurations for the line 140, as desired.

The at least one line 140 may have a first end 142 and a second end 144. The first end 142 of the line 140 may be disposed on the attachment portion 104 of the carriage body 102. The second end 144 of the line 140 may be disposed on the barge 101.

Figure 8:
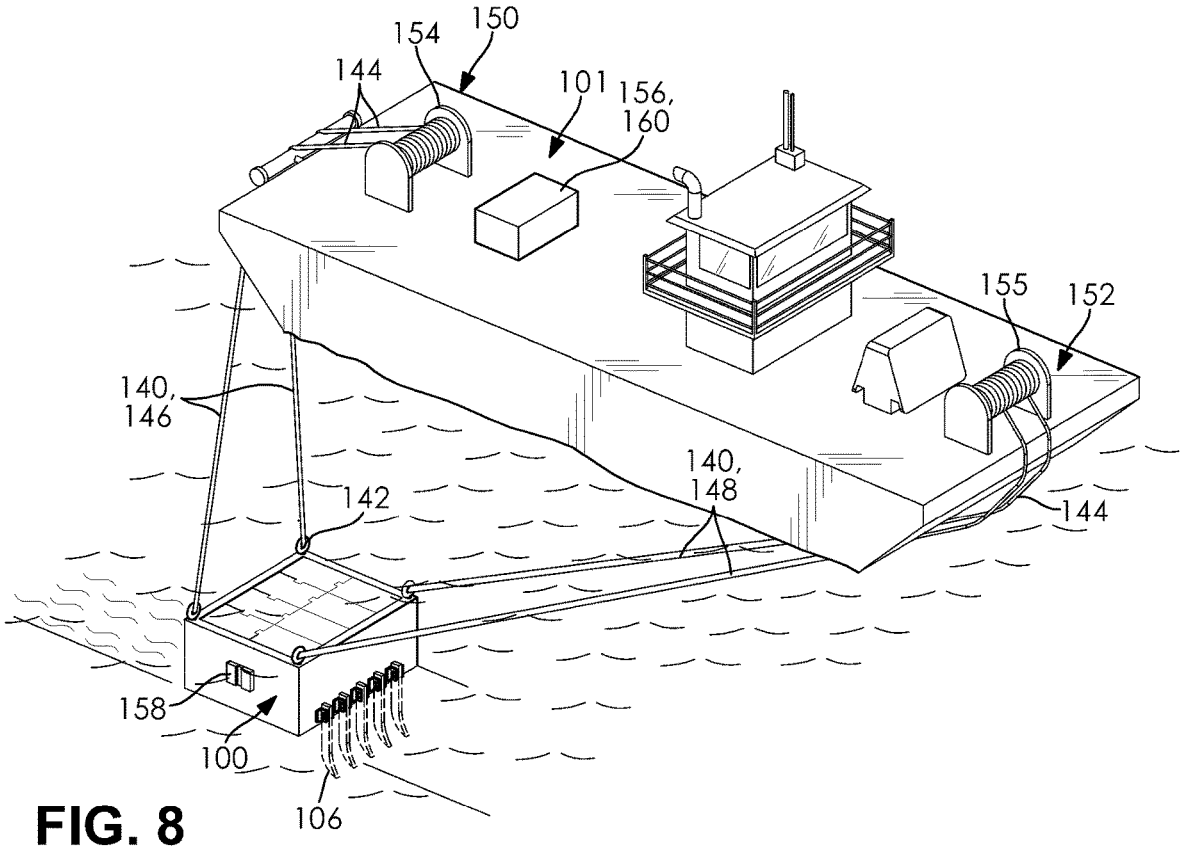
FIG. 8 is a top perspective of a dragging apparatus and barge assembly, according to another embodiment of the present disclosure.

In more particular embodiments, for example, as shown in FIG. 8, the at least one line 140 may be a plurality of lines 140, more particularly, the plurality of lines may include a hanging set of lines 146 and a dragging set of lines 148.

With continued reference to FIG. 8, the first end 142 of each of the set of hanging lines 146 may be disposed on one of the attachment portions 104 of the carriage body 102. The second end 144 of each of the hanging lines 146 may be disposed on a stern end 150 of the barge 101. Where the carriage body 102 is lowered to the floor of the body of water, the set of hanging lines 146 may be disposed substantially perpendicular to the stern end 150 of the barge 101. Accordingly, in operation, the carriage body 102 may be disposed below the stern end 150 of the barge 101.

The first end 142 of each line of the set of dragging lines 148 may be disposed on one of the attachment portions 104 of the carriage body 102. The second end 144 of each of the dragging lines 146 may be disposed on a bow end 152 of the barge 101. In operation, the set of dragging lines 148 may be disposed at an angle relative to the bow end 152 of the barge 101, for example, as shown in FIG. 8. Advantageously, the set of dragging lines 148 may militate against the carriage body 102 from undesirably moving from below the stern end 150 of the barge 101, in operation.

The dragging apparatus 100 may further include at least one reel device 154. The reel device 154 may be disposed on the barge 101. The reel device 154 may be in communication with the set of hanging lines 146. Accordingly, the reel device 154 may be configured to control a vertical displacement of the carriage body 102. In other words, the reel device 154 may raise or lower the carriage body via the hanging lines 146.

A second reel device 155 may also be disposed in the barge 101. The second reel device 155 may be in communication with the set of dragging lines 148. Accordingly, the second reel device 155 may control a length of the dragging lines 148, as needed. A skilled artisan may select other suitable devices and methods for controlling the set of hanging lines 146 and the set of dragging lines 148, as desired.

The dragging apparatus 100 may also include an automation system 156. The automation system 156 may be in electrical communication with the reel device 154 and the second reel device 155. It should be appreciated that the automation system 156 may be configured to raise and lower the carriage body 102 automatically, as needed.

More particularly, the automation system 156 may have at least one leveling device 158 and at least one controller 160. The leveling device 158 may be disposed on at least one of the side walls 112 of the carriage body 102. More particularly, two leveling devices 158 may be disposed on opposing side walls 112. The leveling device 158 may be configured to assess a vertical elevation of the carriage body 102 below water. A differential elevation from the leveling devices 158 on the opposing side walls 112 may be calculated. Accordingly, the leveling device 158 may provide real time data on the state of the carriage body 102 below water, where the carriage body 102 may not be visible.

The at least one leveling device 158 may send a signal 162 to the controller 160, for example, as shown in FIG. 10. The leveling device 158 may send the signal 162 via a transceiver (not shown). Based on the signal 162, the controller 160 may adjust the vertical displacement of the carriage body 102. The controller 160 may also interpret survey data and global positioning (GPS) data along with the signal 162 to further adjust the vertical displacement of the carriage body 102 based on the topography of the floor of the body of water.

Figure 11:
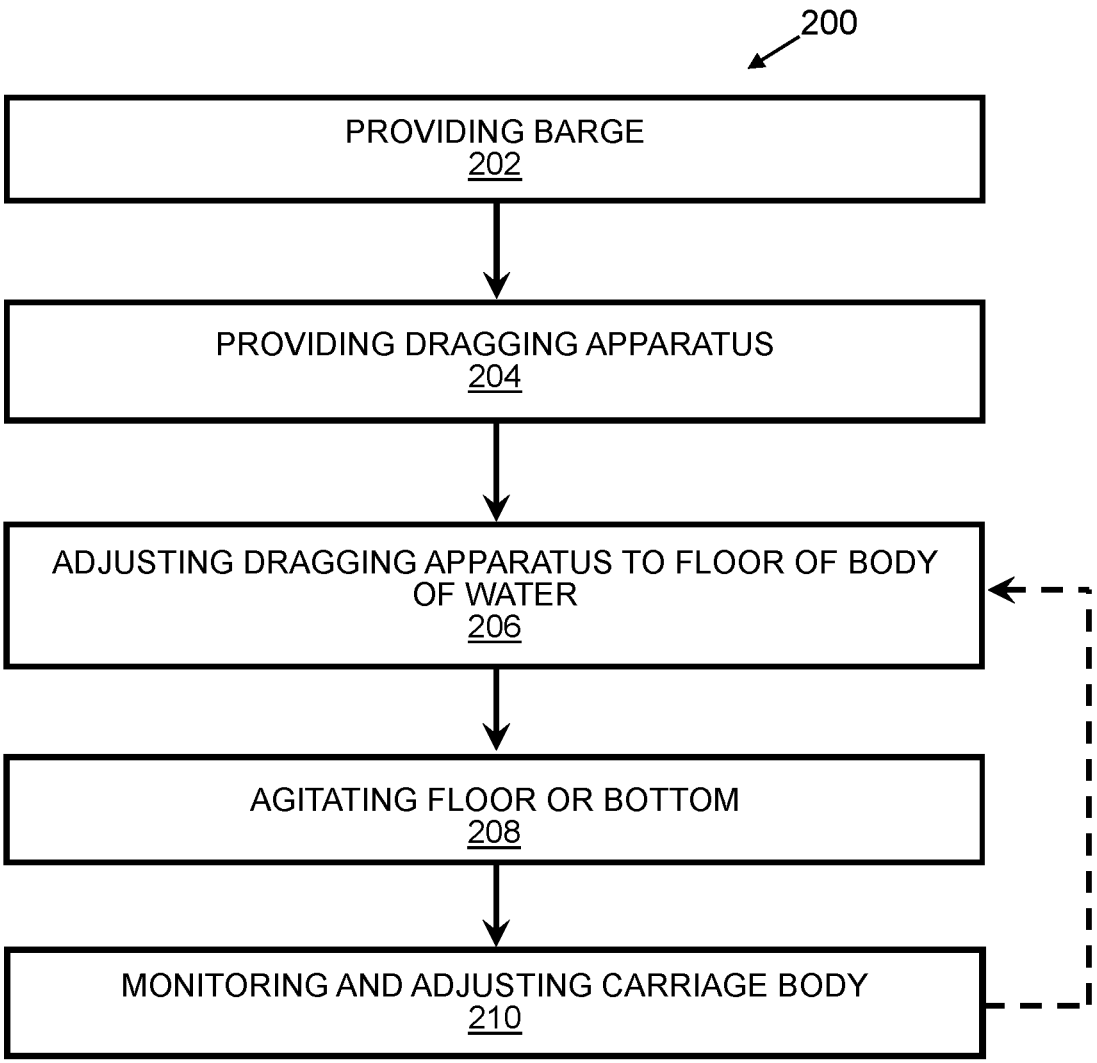
FIG. 11 is a flowchart illustrating a method for operating the dragging apparatus with ripper shank, according to a further embodiment of the present disclosure.

The present disclosure includes a method 200 for operating a dragging apparatus 100, for example, as shown in FIGS. 9-11. A first step 202 in the method 200 may include providing the dragging apparatus 100. A second step 204 in the method 200 may include providing the barge 101, and attaching the dragging apparatus 100 to the barge 101 via the set of hanging lines 146 and the set of dragging lines 148. The number and arrangement of ripper shanks 106 may be customized based on the project requirements. Further, the cutting depth of the ripper attachment 106 may be customized by adjusting the placement of the shaft 126 of the ripper shank 106 in the mechanical fastener 130, as desired.

A third step 206 in the method 200 may include lowering the carriage body 102 to the floor of the body of water. The first reel device 154 and the second reel device 155 may be used to lower the carriage body 102 via the hanging lines 146.

A fourth step 208 of the method 200 may including agitating the floor of the body of water. In particular, the cutting tooth 128 of the ripper shank 106 may create a furrow in the floor as the ripper shank 106 is dragged across the bottom or floor of the body of water by the barge. Thus, the ripper shank 106 is able to loosen hard and compact soil or rocks when dragged by the barge 101.

A fifth step 210 in the method 200 may including monitoring the stability of the dragging apparatus 100 and adjusting the vertical displacement of the carriage body 102. When the ripper shank 106 is agitating the floor, the controller 156 of the automation system 156 may receive the signal 162 from the leveling device 158 and automatically adjust the vertical displacement of the carriage body 102, as deemed necessary by the operator.

It should be appreciated that there may be a continuous feedback loop (identified by the dashed line in FIG. 11) where the vertical displacement of the carriage body 102 in automatically raised and lowered through the automation system 156 once the ripper shank 106 is engaged with the floor or bottom.

After the bottom or floor has been agitated or sufficiently disturbed by the ripper shank 106, the bottom or floor may further be excavated or dredged. A clamshell dredge device or similar device may remove the loosened soil to be transported to another site. A traditional drag beam may also be used to drag the loosened soil to the desired site. It should be understood that one having skill in the art may choose to remove the soil via any available and sufficient method, as desired.

Advantageously, the dragging apparatus 100 of the present disclosure is configured to loosen compacted materials from a floor or bottom of a body of water for dredging or marine construction. Thus, the dragging apparatus may allow for dredging in areas where it was previously not economically feasible.

While certain representative embodiments and details have been shown for purposes of illustrating the invention, it will be apparent to those skilled in the art that various changes may be made without departing from the scope of the disclosure, which is further described in the following appended claims.

What is claimed is:

1. A dragging apparatus, comprising:

a carriage body having at least one attachment portion configured to connect the carriage body to a drag barge;

at least one ripper shank disposed on a front wall of the carriage body and extending downwardly from the carriage body; and two underwater leveling devices disposed on opposing side walls of the carriage body, each leveling device configured to assess a vertical elevation of the carriage body below water, at least one of the underwater leveling devices configured to be in communication with a controller disposed on the barge, the controller configured to receive a signal from at least one of the underwater leveling devices and automatically change the vertical displacement of the carriage body based on the signal.

2. The dragging apparatus of claim 1, wherein the at least one ripper shank is removably disposed on the carriage body.

3. The dragging apparatus of claim 2, wherein the at least one ripper shank is removably disposed on the carriage body via a mechanical fastener.

4. The dragging apparatus of claim 3, wherein the mechanical fastener is a bolt.

5. The dragging apparatus of claim 1, wherein a ripping depth below the carriage body is vertically adjustable.

6. The dragging apparatus of claim 1, wherein the ripper shank has a shaft and a hook.

7. The dragging apparatus of claim 6, wherein the shaft is disposed on the carriage body.

8. The dragging apparatus of claim 1, wherein the dragging apparatus has at least one line, the line may have a first end disposed on the at least one attachment portion and second end disposed on the barge, the line configured to be submerged in at least one of a fresh body of water or a salt body of water for an extended period of time without damaging the line.

9. The dragging apparatus of claim 8, wherein the at least one line is a plurality of lines including a set of hanging lines and a set of dragging lines.

10. The dragging apparatus of claim 9, wherein the second end of each of the set of hanging lines may be disposed on a stern end of the barge, and the second end of each of the set of dragging lines may be disposed on a bow end of the barge.

11. The dragging apparatus of claim 10, further comprising a reel device in communication with the carriage body via the hanging lines, the reel device disposed on the barge.

12. The dragging apparatus of claim 11, wherein the reel device controls a vertical displacement of the carriage body.

13. The dragging apparatus of claim 1, wherein at least one weight is disposed on the carriage body.

14. The dragging apparatus of claim 13, wherein the at least one weight is a plurality of weights.

15. The dragging apparatus of claim 14, wherein the plurality of weights are interlocking weights.

16. A dragging apparatus and barge assembly, comprising:

a barge; and a dragging apparatus including a carriage body having at least one attachment portion, at least one line, the line having a first end disposed on the attachment portion and a second end disposed on the barge, at least one ripper shank disposed on a front wall of the carriage body and extending downwardly from the carriage body, and two underwater leveling devices disposed on opposing side walls of the carriage body, each underwater leveling device configured to assess a vertical elevation of the carriage body below water, at least one of the underwater leveling devices in communication with a controller disposed on the barge, the controller configured to receive a signal from at least one of the underwater leveling devices and automatically change the vertical displacement of the carriage body based on the signal, where a differential elevation from the leveling devices is calculated and the controller is configured to adjust the vertical displacement of the carriage body in response thereto.

17. A method of operation for a dragging apparatus, comprising:

providing a barge;

providing a dragging apparatus having a carriage body having at least one attachment portion configured to connect the carriage body to the barge, at least one ripper shank disposed on a front wall of the carriage body and extending downwardly from the carriage body, and two underwater leveling devices disposed on opposing side walls of the carriage body, each underwater leveling device configured to assess a vertical elevation of the carriage body below water, at least one of the underwater leveling devices in communication with a controller disposed on the barge, the controller configured to receive a signal from at least one of the underwater leveling devices and automatically change the vertical displacement of the carriage body based on the signal;

lowering the dragging apparatus to a floor or bottom of a body of water; and agitating the floor or bottom and calculating a differential elevation from the leveling devices and using the controller to adjust the vertical displacement of the carriage body in response thereto.

* * * * *